US006054813A

United States Patent [19]

Takeda et al.

[11] Patent Number: 6,054,813

[45] **Date of Patent: *Apr. 25, 2000**

[54] NEON DISCHARGING LAMP LIGHTING APPARATUS WITH IMPROVED LIGHTING

[75] Inventors: Masaru Takeda; Eiji Abe; Shigeru Watanabe, all of Ehime-ken, Japan

[73] Assignee: Harison Electric Co., Ltd., Imabari, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/609,047

[22] Filed: Feb. 29, 1996

[30] Foreign Application Priority Data

Apr. 19, 1995 [JP] Japan ..... 7-093363

[51] Int. Cl.[7] ..... H05B 37/00

[52] U.S. Cl. ..... 315/209 R; 315/219; 315/224; 315/DIG. 7

[58] Field of Search ..... 315/219, 209 R, 315/283, DIG. 5, DIG. 7, 224, 291, 307

[56] References Cited

U.S. PATENT DOCUMENTS 5,001,400 3/1991 Nilssen ..... 315/209 R
5,272,327 12/1993 Mitchell et al. ..... 250/205
5,510,680 4/1996 Nilssen ..... 315/209 R

FOREIGN PATENT DOCUMENTS 62-60000 4/1987 Japan .
62-154497 7/1987 Japan .
62-154498 7/1987 Japan .
64-4098 1/1989 Japan .
4-233199 8/1992 Japan .

*Primary Examiner*—David H. Vu
*Attorney, Agent, or Firm*—Henderson & Sturm LLP

[57] ABSTRACT

A neon discharging lamp lighting apparatus comprises a high frequency inverter of which an asymmetrical ratio of an output voltage waveform thereof is designated from 10 to 60% and a low pressure type neon discharging lamp connected to the high frequency inverter. Since the high frequency inverter circuit applies to the low pressure type neon discharging lamp a voltage having a waveform with an asymmetrical ratio for allowing rays of light free from luminance irregularity to be emitted, fringes can be prevented from taking place in rays of light emitted by the low pressure type neon discharging lamp. Thus, the low pressure type neon discharging lamp can operate as a high quality light source.

22 Claims, 5 Drawing Sheets

NEON DISCHARGING LAMP LIGHTING APPARATUS WITH IMPROVED LIGHTING

BACKGROUND OF THE INVENTION

1. Field of the Invention

The present invention relates to a neon discharge lamp lighting apparatus, in particular, to a neon discharging lamp lighting apparatus suitable for an indicator and the like.

2. Description of the Related Art

In the automobile industry, information machine industry, and the like, indicators are often used. A variety of light sources are used for the indicators. As an example of the light sources, a low pressure type neon discharging lamp that features a light color is known. Since the low pressure type neon discharging lamp that contains neon gas as a discharging medium has a peak of light emitting wavelength of 640 nm, which is a bright orange color, it is used for a neon sign, a brake lamp for an automobile, or the like.

In the low pressure type neon discharging lamp, discharging electrodes are air-tightly disposed at both edge portions of a glass tube. The glass tube is filled with neon gas as a discharging medium. The low pressure type neon discharging lamp is connected to an output side of a high frequency inverter. By applying a high frequency voltage from the high frequency inverter to the neon lamp, it ignites. The high frequency inverter is composed of such as a Royer circuit.

However, the conventional neon discharging lamp lighting apparatus has the following problem.

When the high frequency inverter applies a predetermined high frequency voltage to the electrodes of the low pressure type neon lamp through the discharging electrodes, bright and dark fringes or luminance irregularity takes place in the longitudinal direction of the tube of the low pressure type neon discharging lamp. Since the fringes move and stop, the lighting irregularity takes place. In other words, the low voltage type neon discharging lamp irregularly emits rays of light along the tube thereof. In an extreme case, the lamp flickeringly emits rays of light. Thus, when the neon lamp is used for a neon sign or a brake lamp for an automobile, the lamp does not occasionally provide the required indicating capability.

Japanese Patent Laid-Open Publication No. 6-196282 discloses a technology for preventing bright and dark fringes from taking place in a low pressure type neon discharging lamp. In this technology, the output impedance including a resonance condenser connected to a power supply, a ballast condenser, and so forth and the impedance of a low pressure type neon discharging lamp are designated to predetermined ranges and the lighting frequency thereof is controlled.

However, in such a lighting method using a one-transistor type driving circuit, when the capacity of the low pressure type neon discharging lamp is as large as 15 to 30 W, the capacities of the transistor and the transformer in the high frequency inverter circuit should be proportionally increased. In other words, depending on the type (standard) or capacity of the neon discharging lamp, the composition and/or structure of the high frequency inverter varies. Thus, the adaptivity as a light source for an indicator deteriorates, thereby restricting the scope of the applications thereof.

SUMMARY OF THE INVENTION

An intensive study conducted by the inventors of the present invention about the relation between asymmetrical voltage waveforms and fringes that take place in the low voltage type neon discharging lamp show that when negative-positive asymmetrical ratio is designated to a proper range, the fringes can be easily prevented.

Experiments conducted by the inventors of the present invention show that when an auxiliary winding connected in series with a current regulating inductance is connected to a center tap of a primary winding of a transformer that composes a high frequency inverter, the positive-negative asymmetrical ratio can be easily designated in the proper range.

A first object of the present invention is to provide a neon discharging lamp lighting apparatus that can easily prevent fringes from taking place.

A second object of the present invention is to provide a neon discharging lamp lighting apparatus that can easily designate a positive-negative asymmetrical ratio in a proper range.

A first aspect of the present invention is a neon discharging lamp lighting apparatus, comprising a high frequency inverter of which an asymmetrical ratio of an output voltage waveform thereof is designated from 10 to 60% and a low voltage type neon discharging lamp connected to the high frequency inverter.

A second aspect of the present invention is a neon discharging lamp lighting apparatus, comprising a power supply input terminal connected to a DC power supply, a pair of a first transistor and a second transistor whose bases are connected to the power supply input terminal and whose emitters are grounded, a transformer having a first primary winding, a second primary winding, a third primary winding, and a secondary winding, the first primary winding having a center tap and being connected between a collector of the first transistor and a collector of the second transistor, the second primary winding being connected between the power supply input terminal and the center tap, the third primary winding being connected between the base of the first transistor and the base of the second transistor, and a low pressure type neon discharging lamp connected to the secondary wiring of the transformer.

A third aspect of the present invention is a neon discharging lamp lighting apparatus, comprising a power supply input terminal connected to a DC power supply, a pair of a first transistor and a second transistor whose bases are connected to the power supply input terminal and whose emitters are grounded, a transformer having a first primary winding, a second primary winding, and a secondary winding, the first primary winding having a center tap connected to the power supply input terminal and being connected between a collector of the first transistor and a collector of the second transistor, the second primary winding being connected between the base of the first transistor and the base of the second transistor, and a low pressure type neon discharging lamp connected to the secondary wiring of the transformer.

According to the present invention, since the high frequency inverter circuit applies to the low pressure type neon discharging lamp a voltage having a waveform with an asymmetrical ratio for allowing rays of light free from luminance irregularity to be emitted, fringes can be prevented from taking place in rays of light emitted by the low voltage type neon discharging lamp. Thus, the low pressure type neon discharging lamp can operate as a high quality light source.

These and other objects, features and advantages of the present invention will become more apparent in light of the following detailed description of best mode embodiments thereof, as illustrated in the accompanying drawings.

BRIEF DESCRIPTION OF THE DRAWINGS

FIG. 6 is a schematic diagram showing irregular fringes that take place in a neon discharging lamp when it is turned on; and FIG. 7 is a schematic diagram showing irregular fringes that take place in a neon discharging lamp when it is turned on.

DESCRIPTION OF THE PREFERRED EMBODIMENTS

Figure 1:
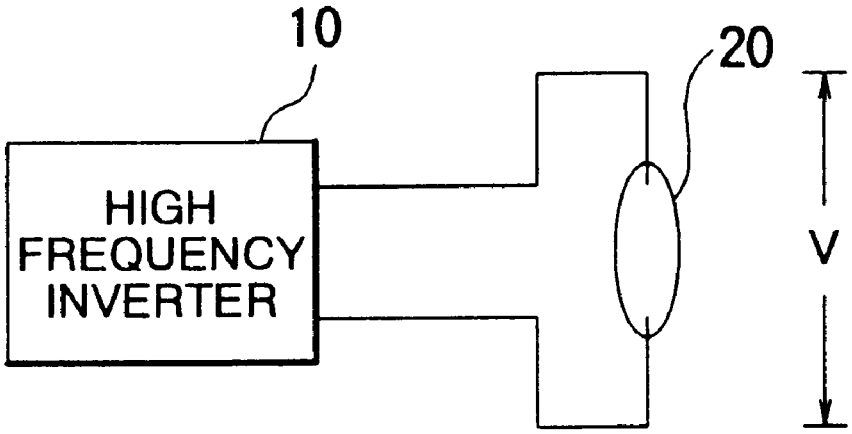
FIG. 1 is a schematic diagram showing a basic structure of a neon discharging lamp lighting apparatus according to an embodiment of the present invention.

FIG. 1 is a schematic diagram showing a basic structure of a neon discharging lamp lighting apparatus according to an embodiment of the present invention.

As shown in FIG. 1, the neon discharging lamp lighting apparatus is composed of a high frequency inverter 10 and a low pressure type neon discharging lamp 20. The high frequency inverter 10 is composed of for example a Royer circuit. The low pressure type neon discharging lamp 20 is connected an output side of the high frequency inverter 10. The asymmetrical ratio of the output voltage waveform of the high frequency inverter 10 is designated from 10 to 60%.

Figure 2:
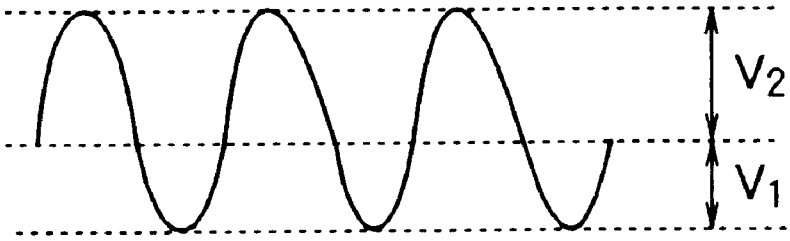
FIG. 2 is a schematic diagram showing a waveform of an AC pressure applied from a high frequency inverter to a low voltage type neon discharging lamp.

As shown in FIG. 2, with a precondition of which the positive amplitude and the negative amplitude of the waveform of an AC voltage V applied from the high frequency inverter 10 to the low voltage type neon discharging lamp 20 is asymmetrical, when the positive maximum value is denoted by V1 and the negative maximum value is denoted by V2, the asymmetrical ratio of the output voltage waveform is defined as follows.

$$\text{Asymmetrical ratio}=[(V2-V1)\div V2]\times 100(\%)$$

The asymmetrical ratio of the output voltage waveform of the high frequency inverter 10 is designated by a combination of a primary winding and a secondary winding of the transformer of the high frequency inverter 10 or by an adjustment of an oscillating portion of the high frequency inverter circuit. More simply, the asymmetrical ratio can be designated by connecting an auxiliary winding connected in series with a current regulating inductance to a center tap of the primary winding of the transformer of the high frequency inverter 10.

When the asymmetrical ratio of the output voltage waveform of the high frequency inverter is less than 10% or exceeds 60%, fringes cannot be prevented. Thus, the asymmetrical ratio should be designated in such a range.

Figure 3:
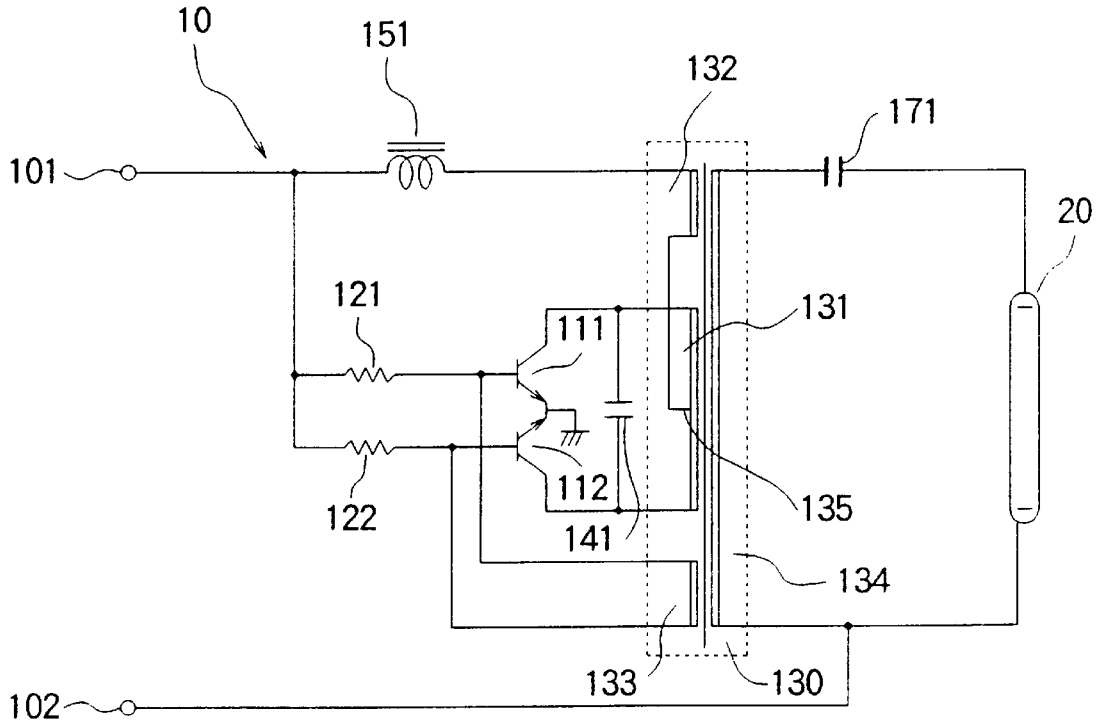
FIG. 3 is a circuit diagram showing the neon discharging lamp lighting apparatus according to the embodiment of the present invention.

FIG. 3 is a circuit diagram of a neon discharging lamp lighting apparatus of which an auxiliary winding connected in series with a current regulating inductance is connected to the center tap of the primary winding of the transformer of the high frequency inverter 10.

In FIG. 3, reference numerals 101 and 102 are power supply input terminals connected to a DC power supply. The power supply input terminal 101 is connected to bases of a pair of a first transistor 111 and a second transistor 112. A bias resistor 121 is connected between the power supply input terminal 101 and the base of the first transistor 111. A bias resistor 122 is connected between the power supply input terminal 101 and the base of the second transistor 112. Emitters of the first transistor 111 and the second transistor 112 are grounded.

A transformer 130 has a first primary winding 131, a second primary winding 132, a third primary winding 133, and a secondary winding 134. The first primary winding 131 has a center tap 135. The first primary winding 131 is connected between collectors of the first transistor 111 and the second transistor 112. The second primary winding 132 is connected between the power supply input terminal 101 and the center tap 135. The third primary winding 133 is connected between the base of the first transistor 111 and the base of the second transistor 112. The first primary winding 131 is connected in parallel with a resonance condenser 141. A current regulating inductance 151 is connected between one terminal of the second primary winding 132 and the power supply input terminal 101.

A low voltage type neon discharging lamp 20 is connected between terminals of the secondary winding 134 of the transformer 130. A ballast condenser 171 is connected between one terminal of the secondary winding 134 and one terminal of the discharging lamp 20. The power supply input terminal 102 is connected to the other terminal of the low voltage type neon discharging lamp 20.

Next, the operation of the above-described neon discharging lamp lighting apparatus will be described.

Whenever either the first transistor 111 or the second transistor 112 is turned on, the transformer 130 is magnetized and the first transistor 111 is quickly turned on. When the magnetic core of the transformer 130 is saturated, the first transistor 111 is turned off. When the first transistor 111 is turned off, a counter electromotive force takes place in the transformer 130. The counter electromotive force is applied to the base of the second transistor 112. Thus, the second transistor 112 is turned on. By repeating such operations, the transformer 130 continues oscillations. An output voltage of the transformer 130 is applied to the low pressure type neon discharging lamp 20. Thus, the low pressure type neon discharging lamp 20 lights.

In the oscillating operation of the transformer 130 considering only the first primary winding 131 and the third primary winding 133, the waveform of the voltage that is output from the transformer 130 is sinusoidal. However, in the oscillating operation of the transformer 130 considering the second primary winding 132 along with the first primary winding 131 and the third primary winding 133, the electric field of the second primary winding 132 affects the sinusoidal waveforms of the voltages of the first primary winding 131 and the third primary winding 133. For example, as shown in FIG. 2, the transformer 130 deforms the sinusoidal waveform of the input voltage to an asymmetrical waveform. The asymmetrical ratio of the waveform of the voltage that is output from the high frequency inverter 10 is in the range from around 10 to 60%. Thus, the low pressure type neon discharging lamp can emit rays of light that are free from fringes.

Next, the structures of the high frequency inverter 10 and the low pressure type neon discharging lamp 20 used in an experiment conducted by the inventors of the present invention will be described in detail.

Figure 4:
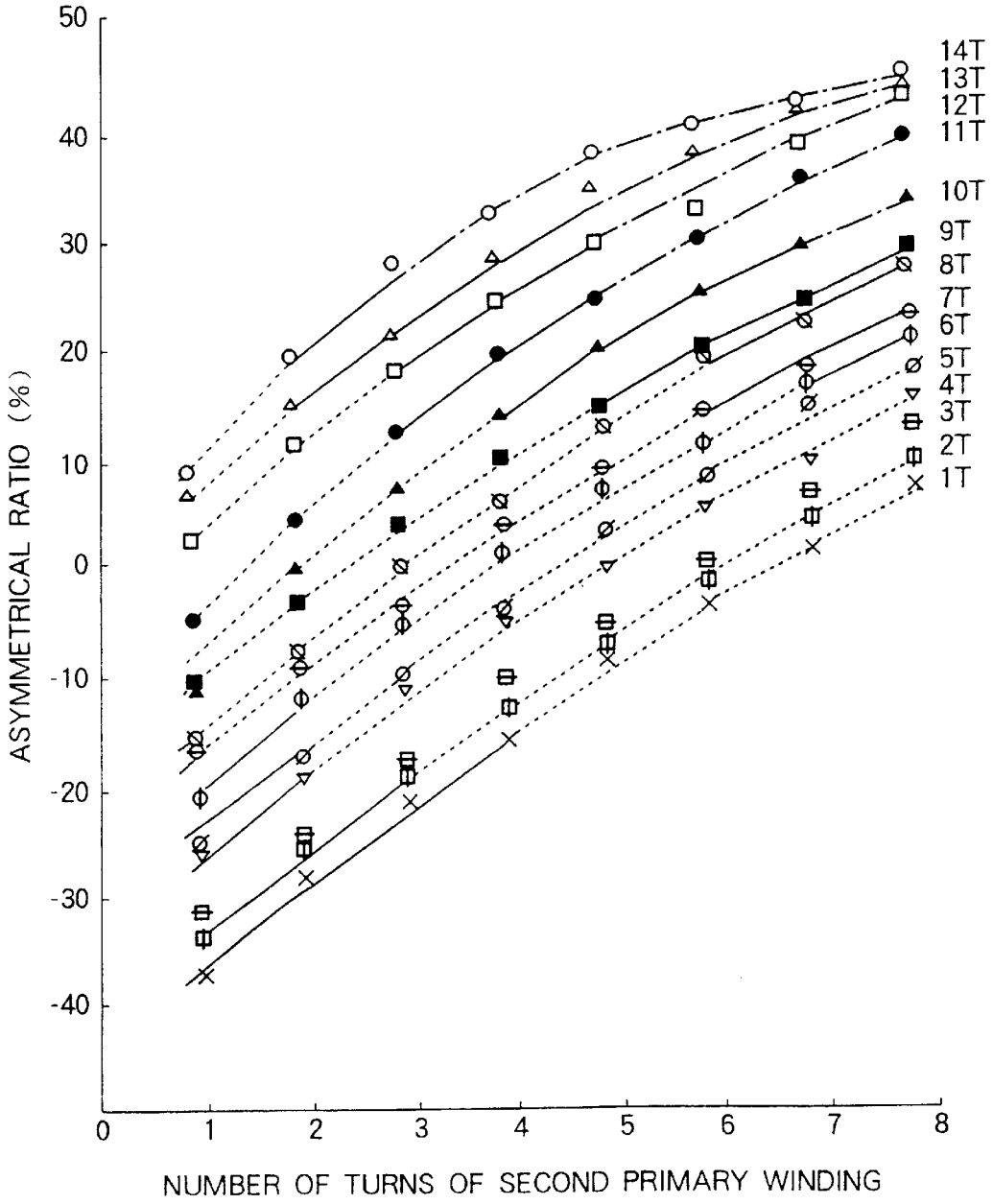
FIG. 4 is a characteristic graph showing an example of the relation between the number of turns of a winding of the high frequency inverter and a symmetrical ratio of an output waveform thereof.

The high frequency inverter 10 used in the experiment has the following structure. The number of turns of a portion between one terminal of the first primary winding 131 and the center tap 135 was in the range from 1 to 14. The number of turns of the other portion between the other terminal of the first primary winding 131 and the center tap 135 was in the range from 1 to 14. The number of turns of the third primary winding was in the range from 1 to 14. The number of turns of the second primary winding 132 was in the range from 1 to 8. The diameter and the length of the low pressure type neon discharging lamp 20 were 6.2 mm and 652 mm, respectively. The pressure of neon gas in the lamp was 3990 Pa. The IL of the lamp was 15 mA rms. The oscillating frequency of the voltage applied to the lamp 20 was 24 kHz. The lamp was lit at a temperature of 25° C. FIG. 4 shows the experimental results. In FIG. 4, solid lines and dotted lines of curves 1T, 2T, . . . , 13T, and 14T represent regions of which fringes take place and regions of which fringes do not take place, respectively. In the experiment, the number of turns of the portion between each terminal of the first primary winding 131 and the center tap 135 was in the range from 1 to 14 and the number of turns of the third primary winding 133 was in the range from 1 to 14.

When the asymmetrical ratio of the waveform of the voltage applied from the high frequency inverter 10 to the low voltage type neon discharging lamp 20 is in the range from 10 to 60%, fringes can be prevented. It seems that the fringes that take place in the lamp apparently move and thereby they disappear.

Figure 5:
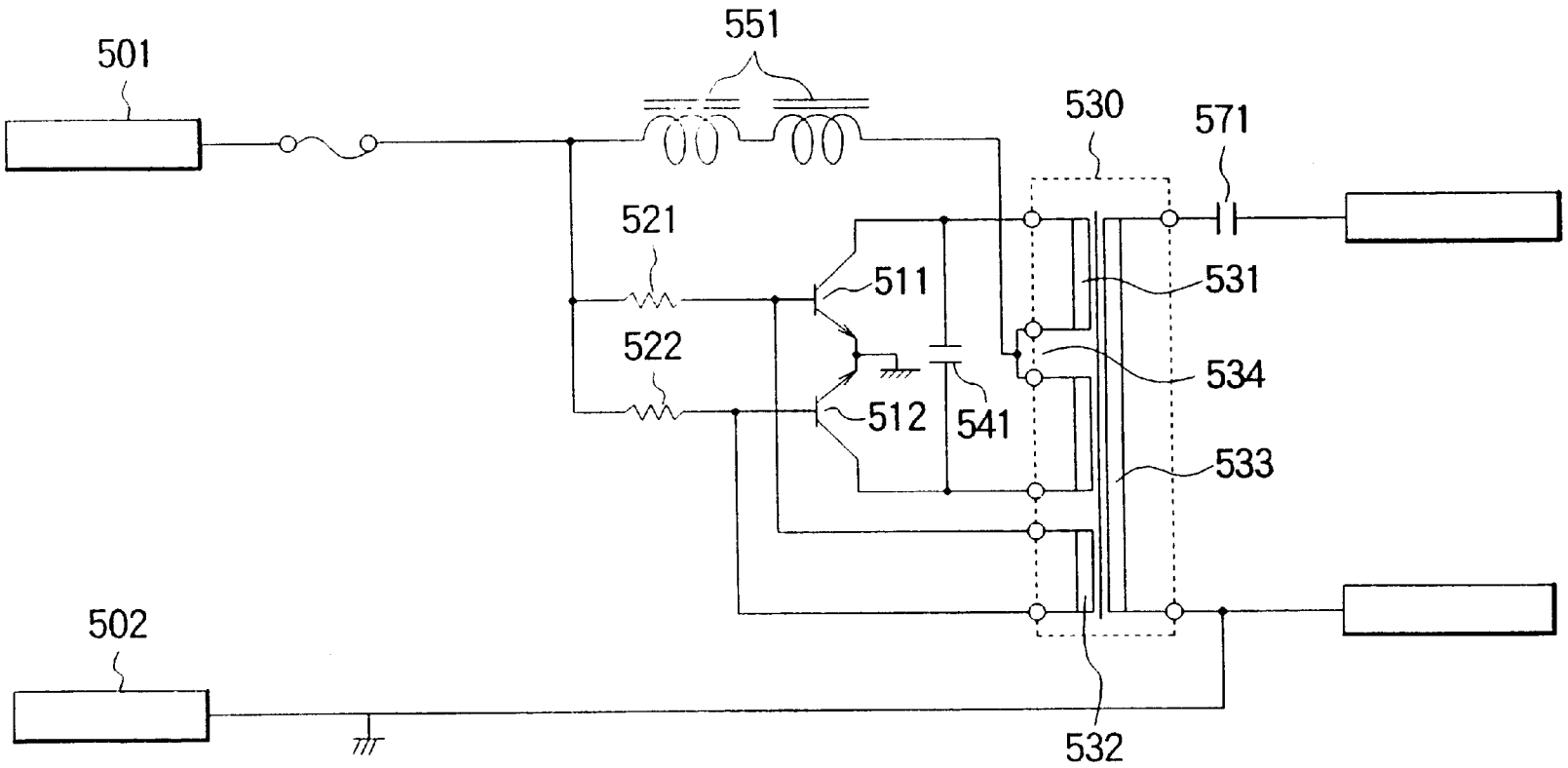
FIG. 5 is a circuit diagram of a neon discharging lamp lighting apparatus according to another embodiment of the present invention.

FIG. 5 is a circuit diagram showing a structure of a high frequency inverter for use with a neon lamp lighting apparatus according to another embodiment of the present invention.

In FIG. 5, reference numerals 501 and 502 are power supply input terminals connected to a DC power supply. The power supply input terminal 501 is connected to bases of a pair of a first transistor 511 and a second transistor 512. A bias resistor 521 is connected between the power supply input terminal 501 and the base of the first transistor 511. A bias resistor 522 is connected between the power supply input terminal 501 and the base of the second transistor 512. Emitters of the first transistor 511 and the second transistor 512 are grounded.

A transformer 530 has a first primary winding 531, a third primary winding 532, and a secondary winding 533. The first primary winding 531 has a center tap 534. The first primary winding 531 is connected between the collector of the first transistor 511 and the collector of the second transistor 512. The power supply input terminal 501 is connected to the center tap 534 through a current regulating inductance 551. The third primary winding 532 is connected between the base of the first transistor 511 and the base of the second transistor 512. A resonance condenser 541 is connected in parallel with the first primary winding 531.

A ballast condenser 571 is connected between one terminal of the secondary winding 533 and one terminal of the low pressure type neon discharging lamp. The power supply input terminal 502 is connected to the other terminal of the low pressure type neon discharging lamp.

In the high frequency inverter, when the number of turns of a portion between one terminal of the first primary winding 531 and the center tap 534 is 3, the number of turns of the other portion between the other terminal of the first primary winding 531 and the center tap 534 is 8, the number of turns of the third primary winding is 2, and the number of turns of the secondary winding 534 is 1000, the same effect as the embodiment shown in FIG. 3 can be accomplished.

In other words, when the number of turns of the portion between one terminal of the first primary winding and the center tap, the number of turns of the portion between the other terminal of the first primary winding and the center tap, the number of turns of the third primary winding, and the number of turns of the secondary winding are properly designated, the high frequency inverter can output the voltage waveform with an asymmetrical ratio of from 10 to 60% without need to use the second primary winding unlike with the embodiment shown in FIG. 3. Thus, the neon discharging lamp can emit rays of light free from fringes.

The present invention is not limited to the above described embodiments. In other words, within the scope of the present invention, a variety of modifications are available. For example, the low pressure type discharging lamp has the same operation and the same effect regardless of whether it is of a straight tube type or a bent tube type.

Figure 6:
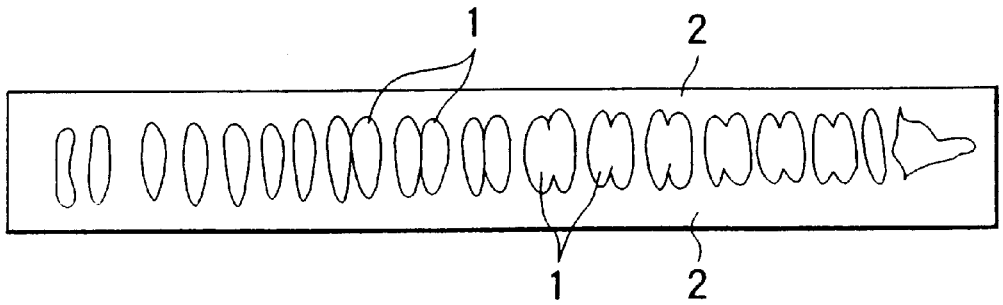
Figure 7:
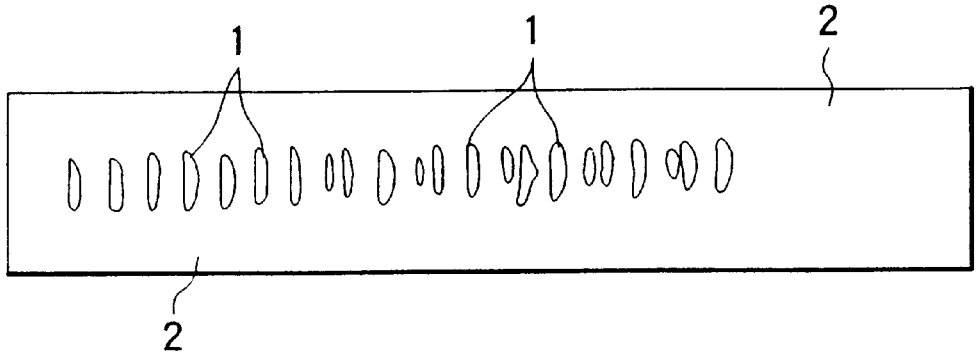

As described above, according to the neon discharging lamp lighting apparatus of the preset invention, fringes can be easily prevented from taking place in the low pressure type neon discharging lamp. Thus, the apparatus can stably emit rays of light free from luminance irregularity. In other words, in the conventional neon discharging lamp lighting apparatus, when the high frequency inverter applies a predetermined high frequency voltage to the inside of the low pressure type neon lamp 3 through the discharging electrodes, as shown in FIGS. 6 and 7, bright and dark fringes or luminance irregularity takes place in the longitudinal direction of the tube of the low pressure type neon discharging lamp. Since the fringes move and stop, the lighting irregularity takes place. In other words, the low pressure type neon discharging lamp irregularly emits rays of light along the tube thereof. In an extreme case, the lamp flickeringly emits rays of light. Thus, when the neon lamp is used for a neon sign or a brake lamp for an automobile, the lamp does not occasionally provide the required indicating capability.

In FIGS. 6 and 7, reference numerals 1 and 2 represent a bright portion and a dark portion, respectively. The bright portion 1 moves. On the other hand, in the neon discharging lamp lighting apparatus according to the present invention, since the low pressure type neon discharging lamp is free from luminance irregularity, the rays of light thereof are very conspicuous. Thus, when the neon discharging lamp lighting apparatus is used for an indicator such as a neon sign, an image can be displayed with a high quality.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A neon discharging lamp lighting apparatus, comprising:

a high frequency inverter of which an asymmetrical ratio of an output voltage waveform thereof is designated from 10 to 60%, said high frequency inverter being composed of Royer circuit; and a low pressure type neon discharging lamp connected to said high frequency inverter;

wherein the Royer circuit comprises:

a power supply input terminal connected to a DC power supply;

a pair of a first transistor and a second transistor whose bases are connected to said power supply input terminal and whose emitters are grounded; and a transformer having a first primary winding, a second primary winding, a third primary winding, and a secondary winding, the first primary winding having a center tap and being connected between a collector of said first transistor and a collector of said second transistor, the second primary winding being connected between said power supply input terminal and the center tap, the third primary winding being connected between the base of said first transistor and the base of said second transistor.

2. The neon discharging lamp lighting apparatus as set forth in claim 1, wherein the number of turns of the first primary winding, the number of turns of the second primary winding, and the number of turns of the third primary winding are designated so that the asymmetrical ratio of the waveform of the output voltage of said transformer is in the range from 10 to 60%.

3. The neon discharging lamp lighting apparatus as set forth in claim 1, wherein the Royer circuit further comprises:

a current regulating inductance disposed between said power supply input terminal and the second primary winding.

4. The neon discharging lamp lighting apparatus as set forth in claim 1, wherein the Royer circuit further comprises:

a resonance condenser connected in parallel with the first primary winding.

5. The neon discharging lamp lighting apparatus as set forth in claim 1, wherein the Royer circuit further comprises:

a ballast condenser disposed between one terminal of the secondary winding of said transformer and one terminal of said low voltage type neon discharging lamp.

6. A neon discharging lamp lighting apparatus, comprising:

a high frequency inverter of which an asymmetrical ratio of an output voltage waveform thereof is designated from 10 to 60%, said high frequency inverter being composed of a Royer circuit; and a low pressure type neon discharging lamp connected to said high frequency inverter;

wherein the Royer circuit comprises:

a power supply input terminal connected to a DC power supply;

a pair of a first transistor and a second transistor whose bases are connected to said power supply input terminal and whose emitters are grounded; and a transformer having a first primary winding, a second primary winding, and a secondary winding, the first primary winding having a center tap connected to said power supply input terminal and being connected between a collector of said first transistor and a collector of said second transistor, the second primary winding being connected between the base of said first transistor and the base of said second transistor.

7. The neon discharging lamp lighting apparatus as set forth in claim 6, wherein the number of turns of the first primary winding and the number of turns of the second primary winding are designated so that the asymmetrical ratio of the waveform of the output voltage of said transformer is in the range from 10 to 60%.

8. The neon discharging lamp lighting apparatus as set forth in claim 6, wherein the Royer circuit further comprises:

a current regulating inductance disposed between said power supply input terminal and the second primary winding.

9. The neon discharging lamp lighting apparatus as set forth in claim 6, wherein the Royer circuit further comprises:

a resonance condenser connected in parallel with the first primary winding.

10. The neon discharging lamp lighting apparatus as set forth in claim 6, wherein the Royer circuit further comprises:

a ballast condenser disposed between one terminal of the secondary winding of said transformer and one terminal of said low voltage type neon discharging lamp.

11. A neon discharging lamp lighting apparatus, comprising:

a power supply input terminal connected to a DC power supply;

a pair of a first transistor and a second transistor whose bases are connected to said power supply input terminal and whose emitters are grounded;

a transformer having a first primary winding, a second primary winding, a third primary winding, and a secondary winding, the first primary winding having a center tap and being connected between a collector of said first transistor and a collector of said second transistor, the second primary winding being connected between said power supply input terminal and the center tap, the third primary winding being connected between the base of said first transistor and the base of said second transistor; and a low pressure type neon discharging lamp connected to the secondary wiring of said transformer.

12. The neon discharging lamp lighting apparatus as set forth in claim 11, wherein the asymmetrical ratio of the waveform of the output voltage of said transformer is designated in the range from 10 to 60%.

13. The neon discharging lamp lighting apparatus as set forth in claim 12, wherein the number of turns of the first primary winding, the number of turns of the second primary winding, and the number of turns of the third primary winding are designated so that the asymmetrical ratio of the waveform of the output voltage of said transformer is in the range from 10 to 60%.

14. The neon discharging lamp lighting apparatus as set forth in claim 11, further comprising:

a current regulating inductance disposed between the power supply input terminal and the second primary winding.

15. The neon discharging lamp lighting apparatus as set forth in claim 11, further comprising:

a resonance condenser connected in parallel with the first primary winding.

16. The neon discharging lamp lighting apparatus as set forth in claim 11, further comprising:

a ballast condenser disposed between one terminal of the secondary winding of said transformer and one terminal of the low pressure type neon discharging lamp.

17. A neon discharging lamp lighting apparatus, comprising:

a power supply input terminal connected to a DC power supply;

a pair of a first transistor and a second transistor whose bases are connected to said power supply input terminal and whose emitters are grounded;

a transformer having a first primary winding, a second primary winding, and a secondary winding, the first primary winding having a center tap connected to said power supply input terminal and being connected between a collector of said first transistor and a collector of said second transistor, the second primary winding being connected between the base of said first transistor and the base of said second transistor; and a low pressure type neon discharging lamp connected to the secondary wiring of said transformer.

18. The neon discharging lamp lighting apparatus as set forth in claim 17, wherein the asymmetrical ratio of the waveform of the output voltage of said transformer is designated in the range from 10 to 60%.

19. The neon discharging lamp lighting apparatus as set forth in claim 18, wherein the number of turns of the first primary winding and the number of turns of the second primary winding are designated so that the asymmetrical ratio of the waveform of the output voltage of said transformer is in the range from 10 to 60%.

20. The neon discharging lamp lighting apparatus as set forth in claim 17, further comprising:

a current regulating inductance disposed between said power supply input terminal and the second primary winding.

21. The neon discharging lamp lighting apparatus as set forth in claim 17, further comprising:

a resonance condenser connected in parallel with the first primary winding.

22. The neon discharging lamp lighting apparatus as set forth in claim 17, further comprising:

a ballast condenser disposed between one terminal of the secondary winding of said transformer and one terminal of the low pressure type neon discharging lamp.

* * * * *